US006148774A

United States Patent [19]

Neill et al.

[11] Patent Number: 6,148,774

[45] Date of Patent: Nov. 21, 2000

[54] POUR-IN-PLACE WATER HEATER FOAM INSULATION SYSTEMS

[75] Inventors: Paul Neill, Grayslake, Ill.; Berwyn Green, Greensboro, N.C.; Ralph Reish, Boyertown, Pa.

[73] Assignee: Stepan Company, Northfield, Ill.

[21] Appl. No.: 09/125,993

[22] Filed: Mar. 12, 1999

Related U.S. Application Data

[60] Provisional application No. 60/012,511, Feb. 29, 1996.

[51] Int. Cl.[7] ..... F02B 75/00

[52] U.S. Cl. ..... 122/19.2; 220/592.1; 220/592.25

[58] Field of Search ..... 122/13.1, 13.2; 126/350 R, 361, 344; 220/592.1, 592.25, 592.26, 62.22; 392/449–454

[56] References Cited

U.S. PATENT DOCUMENTS

| | | | |
|---|---|---|---|
| 4,477,399 | 10/1984 | Tilton . | |
| 4,527,543 | 7/1985 | Denton | 126/361 |
| 4,736,509 | 4/1988 | Nelson . | |
| 4,744,488 | 5/1988 | Nelson . | |
| 4,749,532 | 6/1988 | Pfeffer . | |
| 4,844,049 | 7/1989 | Nelson . | |
| 4,860,728 | 8/1989 | Nelson | 126/361 |
| 4,878,459 | 11/1989 | Nelson . | |
| 4,878,482 | 11/1989 | Pfeffer | 126/375 |
| 4,890,762 | 1/1990 | Pfeffer | 220/444 |
| 4,901,676 | 2/1990 | Nelson . | |
| 4,907,569 | 3/1990 | Lemense | 126/373 |
| 4,979,637 | 12/1990 | Nelson . | |
| 4,998,970 | 3/1991 | Nelson | 126/376 |
| 5,052,347 | 10/1991 | Nelson . | |
| 5,251,282 | 10/1993 | Hanning et al. | 392/449 |
| 5,263,469 | 11/1993 | Hickman | 126/344 |
| 5,419,449 | 5/1995 | Hanning et al. | 220/421 |
| 5,761,379 | 6/1998 | Lannes | 392/451 |

*Primary Examiner*—Pamela Wilson
*Assistant Examiner*—Jiping Lu
*Attorney, Agent, or Firm*—McDonnell Boehnen Hulbert & Berghoff; Steven J. Sarussi

[57] ABSTRACT

The present invention relates to water heater (12) construction whereby thermal insulation material is foamed in the clearance space between the tank and shell of the water heater, wherein the foamed insulation material has lesser uniformity in cell structure and density and a lesser or smaller density in the upper portion of the volume of foam which is disposed over the top of the inner water tank than in the lower portion of the volume of foam insulation material disposed around the side of the inner water tank. The present invention provides gas and electric water heaters with improved energy efficiency, utilizing a liquid, foam-in-place composite foam insulation system. The present invention further provides an improved method for insulating the annular clearance space between an inner water tank and an outer enclosure of a gas or electric water heater.

22 Claims, 6 Drawing Sheets

POUR-IN-PLACE WATER HEATER FOAM INSULATION SYSTEMS

This application is a 371 of PCT/U.S. Ser. No. 97/03,101 filed Feb. 28, 1997 and claims provisional for 60/012,511 filed Feb. 29, 1996.

BACKGROUND OF THE INVENTION

1. Field of the Invention

The present invention comprises an improved foam composite consisting essentially of a water-blown foam (a non-hydrochlorofluorocarbon, HCFC) and a HCFC-blown polyurethane foam. The foam composites of the present invention provide improved insulation properties to devices, particularly gas and electric water heaters, as compared to standard foams which are entirely water-blown foams.

2. Description of the Related Art

Conventional water heater construction includes a generally cylindrical outer shell concentrically placed around the inner water tank leaving an annular space therebetween. The construction is completed by filling this annular space with some type of thermal insulation material, typically liquid, foam-in-place insulation material. The construction is completed by putting some type of top cover or enclosure over the top of the inner water tank and over the upper top edge of the outer shell so as to enclose the annular space. Likewise, some type of lower or base cover or enclosure is provided beneath the water tank in a similar fashion.

The specific arrangement of foam insulation within the annular space may include any of the variations disclosed by the, following U.S. Pat. Nos.:

| U.S. Pat. No. | Patentee Issue Date |
|---|---|
| 4,477,399 | Tilton 10/1611984 |
| 4,527,543 | Denton 07/09/1985 |
| 4,736,509 | Nelson 04/12/1988 |
| 4,744,488 | Nelson 05/17/1988 |
| 4,749,532 | Pfeffer 06/07/1988 |

Tilton discloses a method for insulating a water heater with foamed insulation and includes inflating a tube in the cavity between the shell of the tank in order to define a boundary for the cavity into which the insulating material is injected. The device is then deflated after the foamed insulation has set in the cavity. Denton discloses a water heater construction with an insulating space between the outer cover member and the inner water tank. A cover is used on the top in order to close off the insulating space and an insulating wall is provided in the insulating space between the tank and the outer cover. The insulating wall is comprised of a plastic envelope member and a wall of insulating material which has been foamed-in-place inside the plastic envelope member.

Nelson U.S. Pat. No. "509 discloses a method of making a water heater which includes the steps of locating a sleeve of insulation material around the exterior wall surface of the inner tank extending from approximate the bottom end of the inner tank and extending upwardly longitudinally thereof a predetermined distance which is less than the full length of the inner tank. The next step is folding the top end of the insulation sleeve back over itself in order to form an annular cuff at the top end of the sleeve and the positioning the outer shell concentrically over the inner tank whereupon the annular cuff is compressed between the interior wall surface of the outer shell and the exterior wall surface of the inner tank. The annular clearance space above the annular cuff of the sleeve is then filled with an expandable foam insulation material which is allowed to foam in place.

Nelson U.S. Pat. No. "488 discloses a water heater construction where a control apparatus, such as a thermostat, is located on the exterior wall surface of the inner tank and the outer shell includes an aperture which is in alignment with the control apparatus. The specific invention involves the disclosure of a collar which is located around the control apparatus and is compressed between the inner tank and the outer shell in order to provide a sufficiently sealed barrier around the thermostat such that when the space between the inner tank and the outer shell is filled with a foam insulation material, this foam insulation material will not interfere with the thermostat or other control which may be sealed around by this invention.

The Pfeffer patent discloses a water heater construction wherein foam insulation fills a cavity between the tank and the outer shell and is disposed above a bottom wall which is formed by a preassembled fiberglass belt. This fiberglass belt is wrapped and secured around the outer diameter of the tank by an encircling and compressing band. The top and bottom edges of the belt flare outwardly to a diameter size which is in excess of the inner diameter of the shell. A flat, flexible plastic sheet is used much like a shoehorn in order to compress the belt as the outer shell is lowered into position. This flexible plastic sheet is then removed and the space above the belt is foamed with foam-in-place insulation material.

The specific configuration of the foam insulation depends in part on whether the particular water heater is gas or electric. When constructing an electric water heater, the lower portion of the tank does not have special insulation requirements. However, there are operational controls which must be insulated around and a suitable technique for such insulating is disclosed in U.S. Pat. No. 4,744,488 which is expressly incorporated herein by reference.

When constructing a gas water heater, the lower portion of the tank represents a particularly hot area with special insulating requirements. Liquid foam insulation is not suitable for this hot area and fiberglass matting or batt material is used instead. A further feature of typical water heater construction is the need for the water inlet and outlet fittings (pipes) to exit from the tank through the top cover portion of the outer enclosure which is either attached to or fabricated as part of the outer generally cylindrical shell. When a gas water heater is constructed, a flue for the byproducts of the combustion must be provided out the top of the shell in addition to the inlet and outlet water conduits. These conduits and the exhaust flue must be sealed around at the interface with the enclosure or top cover so that as the liquid, foam-in-place insulation rises and expands, it does not leak out around the conduits and flue. In the typical construction approach, a top cover and a bottom cover are assembled to the shell in order to form an enclosed, exterior cylinder.

A variety of insulation materials and insulating methods are used in typical water heater construction in an attempt to produce an energy-efficient unit at the lowest possible cost based on materials and manufacturing labor. This desire has led to the development of many methods for insulating water heaters with a liquid, foam-in-place insulation material such as polyurethane or polyisocyanurate insulation material. All of the methods currently being used entail the use of sealing devices of some type in order to keep the foam insulation within the space between the tank and the outer cylindrical shell. This approach can be costly in terms of material and labor and other manufacturing concessions may need to be made, such as assembly line speed, in order to accommodate the placement of the sealing devices within the cavity formed by the tank and shell.

Gas-fired water heaters and electric powered water heaters have different design features and thus the sealing considerations prior to foaming are different for each. However, in most conventional manufacturing methods, there are similar constraints for effectively sealing the cavity between the tank and shell. In all commonly used methods there are several drawbacks that greatly increase the cost of achieving a given energy rating for the water heater. These methods are also a less-efficient use of the costly foam insulation.

U.S. Pat. No. 5,052,347, incorporated herein by reference, addresses the basic principles of the thermodynamics and the processing characteristics of foam insulation in order to provide a more efficient water heater. This disclosure describes the use of HCFC as the most efficient blowing agent in the foaming process, allowing foam insulation to achieve R values in excess of other commonly used insulation materials.

However, new governmental standards aimed at protecting the environment, in particular the earth's ozone layer, are mandating sharper cuts in the use of HCFC. The desire to achieve higher efficiency ratings in terms of R value is in conflict with the government's desire to protect the ozone layer.

The present invention is directed to the construction of a water heater which is manufactured by first positioning individual sealing gaskets over each protrusion such as plumbing fittings, which extend from the tank, or by first positioning a unitary sealing device over the collective protrusions and then fitting the tank with a top cover which is one portion of the enclosing means for the tank. This top cover has openings to allow the tank protrusions to extend there through. This top cover is further configured in such a way as to contact each individual sealing gasket or the unitary sealing device in order to provide a liquid-tight seal at the interface between the operating connections extending from the tank through the top cover with the top cover.

In one approach the next step is to turn or invert the tank and cover assembly so that it is upside down from its normal position so that the top cover is in the lowermost position and the bottom of the tank has assumed the normal top position. The surrounding generally cylindrical outer shell is then positioned over the tank with a concentric space left between the outer surface of the inner tank and the inner surface of the outer shell. Some type of sealing is provided between the shell and the top cover either in individual form or as part of the unitary seal used around the tank protrusions. However, it should be noted that inversion of the tank is not required in the present invention.

As an alternative approach to these first steps, the cover and the generally cylindrical outer shell are preassembled and sealed together in order to create a single unit. This assembled single unit of cover and outer shell is placed over the tank prior to inverting the tank. When the inverting step is performed it is performed for both the tank and the cover/shell assembly.

A further alternative is to fabricate the cover and the outer shell as an integral one-piece member, such as a molded plastic unit and then assemble this unit over the tank prior to inverting the tank. This eliminates the step of sealing together the cover and shell.

If the tank is optionally inverted and expandable insulation foam (liquid, foam-in-place insulation) is injected into the clearance space between the tank and the top cover and between the tank and the surrounding outer shell. As this liquid foam expands to fill the space, it rises in effect from the top of the tank toward the bottom of the tank. Since the bottom at this point is open, any space or voids left that are not fully foamed are filled with dry insulation such as fiberglass matting or batts which can be easily stuffed into any space left at what will ultimately be the bottom of the foam insulation. Finally, an insulation disc or bottom cover can be placed over the bottom of the tank in order to complete the assembly. After the foam has cured to a sufficient degree, the entire assembly is then inverted back to its normal upright position and the construction is completed.

As disclosed in U.S. Pat. No. 5,052,347, when insulation material is injected to the annular clearance space between the outer shell and the water tank, when these are in their normal upright orientation, the foaming process begins at a lower portion of the tank along the side of the tank. As the foam rises toward the top of this annular clearance space, the quality of the foam decreases. The lowermost portion of the cavity which is foamed first is described as having a higher-density foam, and a more uniform density and a more-consistent cell structure to the foam than the uppermost portion of the cavity. Also as disclosed, heat transfer and thermodynamics tell us that it is preferred to have the top of the unit better insulated than the lower side portion in order to achieve the most energy-efficient design based upon using a fixed or given volume of foam.

To further compound the manufacturing problems of current foaming methods, a predetermined amount of liquid is injected into the annular space between the shell and the tank and the manufacturing methods rely on the accuracy and consistency of the foam machinery in order to inject exactly the same amount of foam with each unit being constructed. However, there are variations in the cavity volume and variations in how accurately the amount of liquid foam can be controlled as well as simply variations in the foaming process due to the chemistry of the insulation material. The result, as is believed to be well known, is noticeable variations from one water heater to another thus meaning that there is no guarantee that for any one water heater, the annular clearance space including the space between the outer enclosure and the top of the water tank is completely filled with foam insulation. It is known that when under-foamed, the most critical top portion of the tank has insulation voids or openings resulting in a very inefficient design. If too much liquid is injected or if the foam chemistry or temperature vary in such a way to allow a greater degree of foaming than what has been calculated for the available space, the foam leaks out around the plumbing fittings and other protrusions at the top of the cover and this results in a significant cleanup and appearance problem.

The necessity of high-speed assembly line production simply cannot adequately deal with these variables, and since the over-fill problem cannot be overlooked due to the unsightly appearance, the tendency is to under-design the amount of liquid foam so that any over fill is eliminated. Additionally, conventional pour-in-place foams are not dimensionally stable in the free-rise state, i.e. they are prone to shrinkage. This shrinkage further diminishes the energy efficiency of the water heater. The problem as referenced above generally means that the top portion of the clearance space, that portion above the water tank top, is very inefficiently insulated and thus the thermal insulation efficiency of the overall construction is inferior.

The present invention uses a significant amount of water blown foam in the bottom clearance space of the tank, which significantly reduces the overall costs of the foam composite. Typically, the present invention generally allows for omission of auxiliary heating of the cavity to be filled with the foam composite, as heat is spontaneously generated from the exotherm of the water blown foam.

SUMMARY OF THE INVENTION

A water heater construction according one typical embodiment of the present invention includes an inner water tank, an outer enclosure disposed over and around the inner water tank and defining therebetween a clearance space, thermal insulation material foamed in place between the tank and shell in the clearance space wherein the foamed insulation material has lesser uniformity in cell structure and density and a lesser or smaller density in the upper portion of the volume of foam which is disposed over the top of the inner water tank than in the lower portion of the volume of foam insulation material disposed around the side of the inner water tank.

A method of insulating the clearance space between an inner water tank and an outer enclosure which surrounds and covers the water tank according to one embodiment of the present invention comprises the steps of first, optionally inverting the inner water tank and the outer enclosure such that the normal position of the top portion of the clearance space becomes the lowest portion of the inverted clearance space and then injecting liquid, foam-in-place insulation material into the clearance space so as to foam the normal-position top portion first.

One object of the present invention is to provide an improved water heater construction.

Another object of the present invention is to provide an improved method for insulating the annular clearance space between an inner water tank and an outer enclosure.

These and other objects and advantages, as well as the scope, nature, and utilization of the claimed invention will become apparent to those skilled in the art from the following detailed description and claims.

In a preferred embodiment, the water heater is foamed with the tank in a conventional up right position; i.e., not inverted.

DETAILED DESCRIPTION OF THE INVENTION

Figure 1:
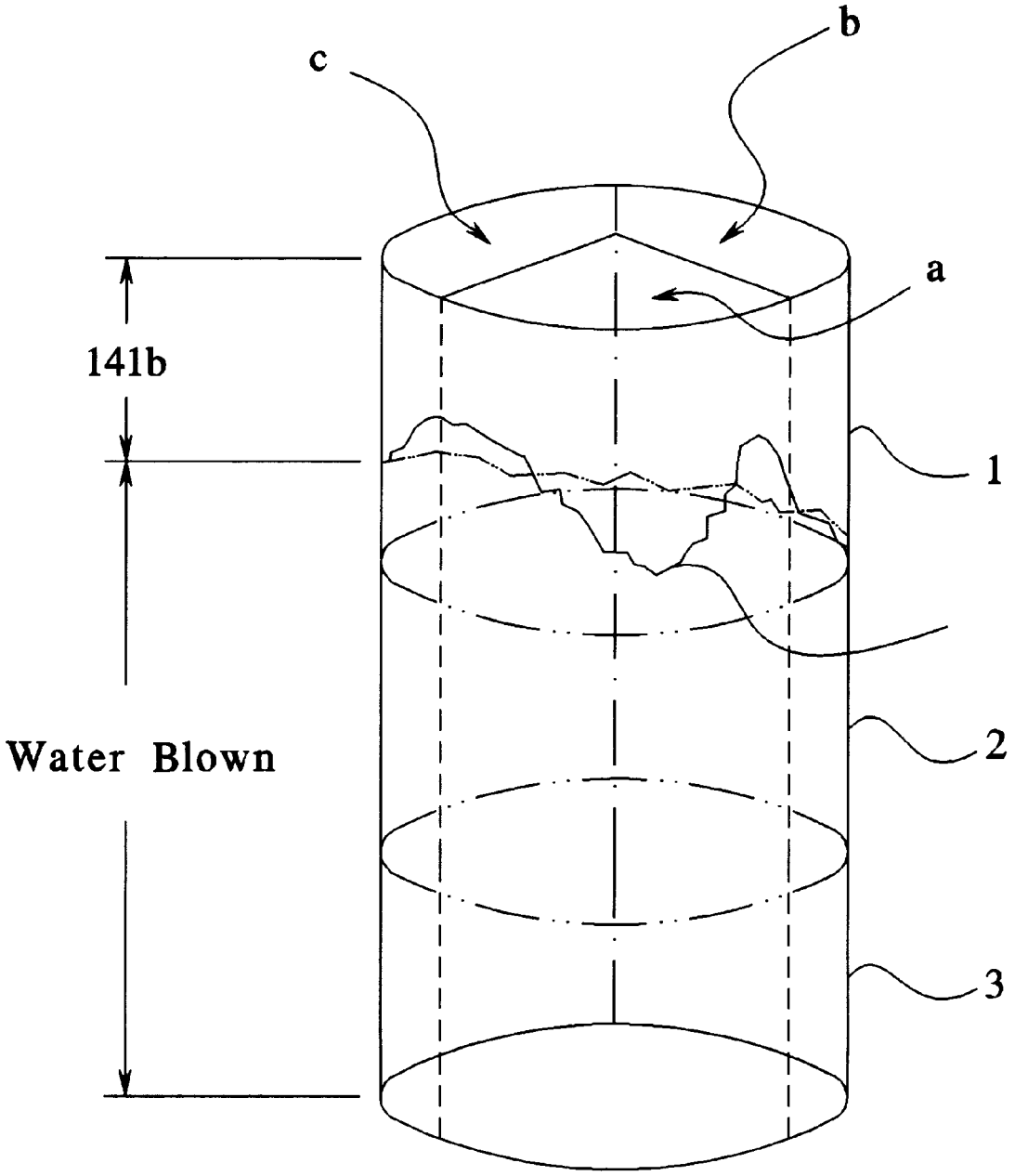
FIG. 1 is a drawing representing a dual foam filled gas water heater, wherein the 141*b* region represents approximately 25% of the overall foam volume by weight, and is filled with 141*b*-blown foam; and wherein the water blown foam region represents approximately 75% of the remaining foam volume, and is filled with conventional water blown foam. Regions 1,2, and 3 represent horizontal cross sectional regions of foam from which samples are obtained after filling the heater. The samples are employed to determine foam densities. Regions a, b, and c are vertical cross sectional volumes from which foam samples are removed after filling the water heater. Again, the samples are used to determine foam densities. Line 10 represents the interface between water-blown foam and HCFC 141b-blown foam.

The present invention involves a method for foaming gas and electric water heaters with a liquid, foam-in-place composite foam insulation system. The present invention also is directed to the water heater construction which results from the method for foaming.

The present invention involves water heater construction comprising an inner water tank (300); an outer enclosure means (302) disposed over and around said inner water tank and defining therebetween a clearance space (304); a composite foam insulation system foamed in place between the tank and outer enclosure means in said clearance space; wherein the composite foam insulation system has at least two distinct foam components; wherein the composite foam insulation system comprises a first foam component (306) and a second foam component (308); wherein the first foam component possesses equal or lesser uniformity in cell structure as compared to the second foam component; wherein the first foam component is located in the volume disposed over the top of said inner water tank and the second foam component is located in the lower portion of the volume of said composite foam insulation system disposed around the side and/or bottom of said inner water tank; wherein any portion of said clearance space including clearance space located around said inner water tank, below the first foam component, comprises the second foam component; wherein said enclosing means includes a generally cylindrical outer shell and a generally cylindrical cover joined thereto; wherein said inner water tank includes a plurality of plumbing fittings extending from said tank and through said enclosing means and wherein said water heater construction further includes gaskets sealing the interface between said fittings and said enclosing means; wherein the second foam component is another type of insulation material, different from the first foam component: wherein a plurality of spacers are disposed between the outer surface of said inner tank and the inner surface of said enclosure means so as to maintain a desired spacing therebetween, wherein the first foam component and the second foam component are added to the clearance space independently; wherein said inner tank includes a plurality of plumbing fittings and said outer enclosure means includes clearance openings for said fittings. The location of said openings providing control of the position of said water tank within said outer enclosure means; wherein the first foam component is blown with a blowing agent: wherein the blowing agent is at least one volatile blowing agent selected from the group consisting essentially of hydrochlorofluorocarbon of one or two carbon atoms, hydrofluorocarbons of two to four carbon atoms, perfluorocarbons of four to six carbon atoms, methylene chloride a hydrocarbon of 1 to 8 carbon atoms, pentane. cyclopentane and chloropentane, or a mixture thereof, or a mixture of the volatile blowing agent with water; wherein the second foam component is water-blown.

Generally, the second foam component is substantially dimensionally stable in a free rise state, i.e. it does not shrink. By free rise is meant that this foam is introduced into the cavity and partially fills the cavity thereby leaving an unfilled portion of space in the cavity. Additionally, the second foam component may be a substantially open celled foam; i.e. an open celled content such that foam doesn't shrink in or free rise state.

The present invention further involves water heater construction comprising an inner water tank; an outer enclosure means disposed over and around said inner water tank and defining therebetween a clearance space; a composite foam insulation system foamed in place between the tank and outer enclosure means in said clearance space; wherein the composite foam insulation system has at least two distinct foam components; wherein the composite foam insulation system comprises a first foam component and a second foam component; wherein the first foam component possesses equal or lesser uniformity in foam density as compared to the second foam component; wherein the first foam component is located in the volume disposed over the top of said inner water tank and the second foam component is located in the lower portion of the volume of said composite foam insulation system disposed around the side and/or bottom of said inner water tank; wherein any portion of said clearance space, including clearance space located around said inner water tank, below the first foam component, comprises the second foam component', wherein said enclosing means includes a generally cylindrical outer shell and a generally cylindrical cover joined thereto; wherein said inner water tank includes a plurality of plumbing fittings extending from said tank and through said enclosing means and wherein said water heater construction further includes gaskets sealing the interface between said fittings and said enclosing means; Wherein the second foam component is another type of insulation material, different from the first foam component; wherein a plurality of spacers are disposed between the outer surface of said inner tank and the inner surface of said enclosure means so as to maintain a desired spacing therebetween; wherein the first foam component and the second foam component are added to the clearance space independently; wherein said inner tank includes a plurality of plumbing fittings and said outer enclosure means includes clearance openings for said fittings. The location of said openings providing control of the position of said water tank within said outer enclosure means; wherein the first foam component is blown with a blowing agent; wherein the blowing agent is at least one volatile blowing agent selected from the group consisting essentially of hydrochlorofluorocarbons of one or two carbon atoms, hydrofluorocarbons of two to four carbon atoms, perfluorocarbons of four to six carbon atoms, methylene chloride, a hydrocarbon of 1 to 8 carbon atoms, pentane, cyclopentane and chloropentane, or a mixture thereof, or a mixture of the volatile blowing agent with water; wherein the second foam component is water-blown.

The present invention further involves water heater construction comprising an inner water tank; an outer enclosure means disposed over and around said inner water tank and defining therebetween a clearance space; a composite foam insulation system foamed in place between the tank and outer enclosure means in said clearance space; wherein the composite foam insulation system has at least two distinct foam components; wherein the composite foam insulation system comprises a first foam component and a second foam component; wherein the first foam component possesses equal or lesser foam density as compared to the second foam component; wherein the first foam component is located in the volume disposed over the top of said inner water tank and the second foam component is located in the lower portion of the volume of said composite foam insulation system disposed around the side and/or bottom of said inner water tank; wherein any portion of said clearance space, including clearance space located around said inner water tank, below the first foam component, comprises the second foam component; wherein said enclosing means includes a generally cylindrical outer shell and a generally cylindrical cover joined thereto; wherein said inner water tank includes a plurality of plumbing fittings extending from said tank and through said enclosing means and wherein said water heater construction further includes gaskets sealing the interface between said fittings and said enclosing means; wherein the second foam component is another type of insulation material, different from the first foam component; wherein a plurality of spacers are disposed between the outer surface of said inner tank and the inner surface of said enclosure means so as to maintain a desired spacing therebetween; wherein the first foam component and the second foam component are added to the clearance space independently; wherein said inner tank includes a plurality of plumbing fittings and said outer enclosure means includes clearance openings for said fittings, the location of said openings providing control of the position of said water tank within said outer enclosure means; wherein the first foam component is blown with a blowing agent; wherein the blowing agent is at least one volatile blowing agent selected from the group consisting essentially of hydrochlorofluorocarbons of one or two carbon atoms, hydrofluorocarbons of two to four carbon atoms, perfluorocarbons of four to six carbon atoms, methylene chloride, a hydrocarbon of 1 to 8 carbon atoms, pentane, cyclopentane and chloropentane, or a mixture thereof, or a mixture of the volatile blowing agent with water; wherein the second foam component is water-blown.

As mentioned in the background discussion regarding the present invention, the liquid foam is often injected as a pretimed and premeasured amount and thus as the chemistry of the foam, temperature, humidity and related environmental changes as well as volume changes take place, there will either be too much foam injected which causes an overfill and a cleanup problem, or there is less liquid injected and complete foaming is not achieved such that the level of the foamed insulation does not cover the top of the inner tank. A further object of the present invention is water heater construction, wherein the use of the pour-in-place foam system produces a reduction in reportable emissions without sacrificing energy performance, as compared to the reportable emissions of other pour-in-place foam systems.

In the following examples, all amounts are stated in percent by weight unless indicated otherwise.

One skilled in the art will recognize that modifications may be made in the present invention without deviating from the spirit or scope of the invention. The invention is illustrated further by the following examples which are not to be construed as limiting the invention or scope of the specific procedures or compositions described herein. All documents, e.g., patents and journal articles, cited above or below are hereby incorporated by reference in their entirety.

EXAMPLE 1

A conventional 40 gallon electric water heater is first filled, i.e. the clearance space between the outer wall and the inner water tank, with ~75% water-blown foam (by weight of total foam weight), such as Stepanfoam® RI-9645, which is open cell and dimensionally stable in the free-rise state. Stepanfoam® RI-9645 is derived from a blend of polyester and polyether polyols, a silicone surfactant, an amine catalyst, a cell opener. a dispersing agent and water; the foam is commercially available from Stepan Company, Northfield, Ill. The foam formulation blend is mixed with polymeric isocyanate using standard low or high pressure mixing/dispensing equipment, at typical component temperatures and pressures known to one skilled in the art. The water-blown foam is allowed to rise to its full height. The remaining void in the top portion of the water heater clearance space is then filled with HCFC-141*b* blown foam. The weight of the HCFC-141*b* blown foam is approximately 25% of the final foam weight in the water heater. The HCFC-141*b* blown foam is Stepanfoam® RI-9652. also available from Stepan Company, Northfield, Ill. Stepanfoam® RI-9652 is derived from a blend of polyester and polyether polyols, a silicone surfactant, an amine catalyst, water, and HCFC-141*b*. The formulation blend is mixed with polymeric isocyanate using standard low or high pressure mixing/dispensing equipment, at typical component temperatures and pressures, known to one skilled in the art.

Figure 2:
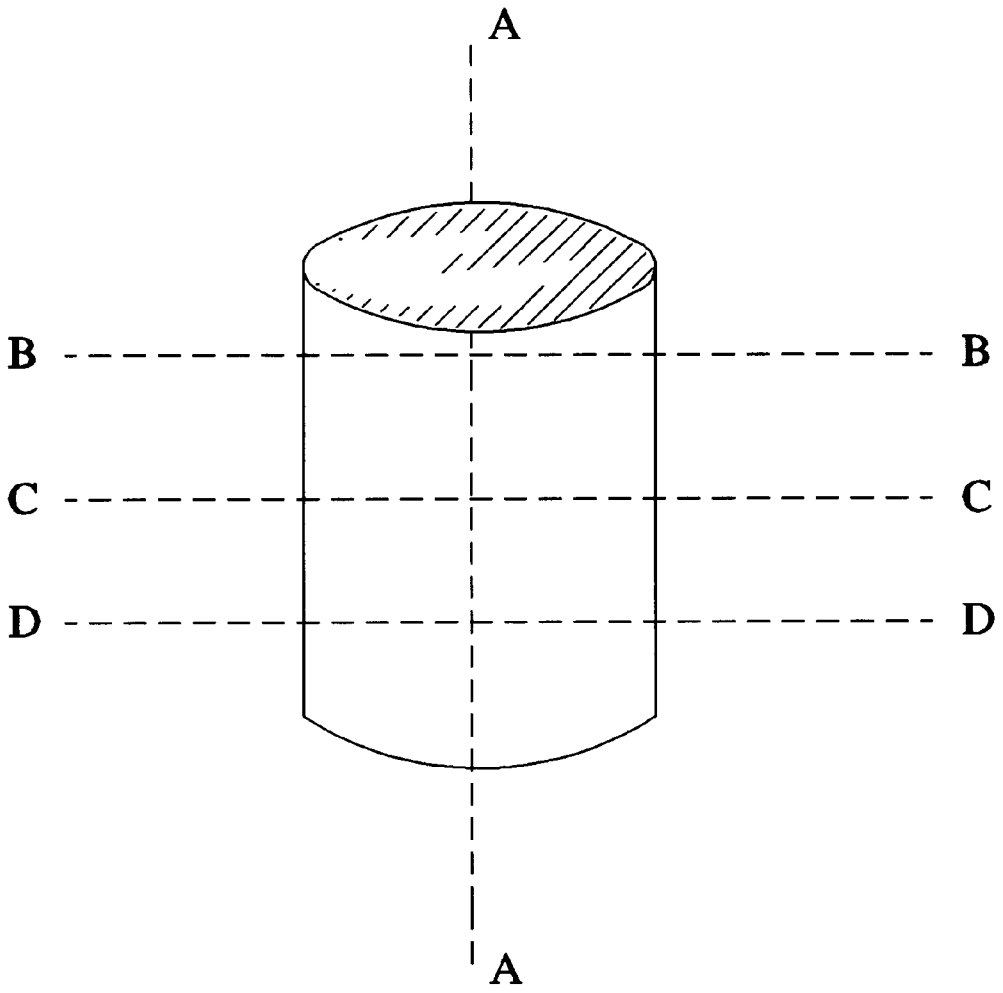
FIG. 2 is a three dimensional front view of a dual foam water heater 12 according to the invention.
Figure 3:
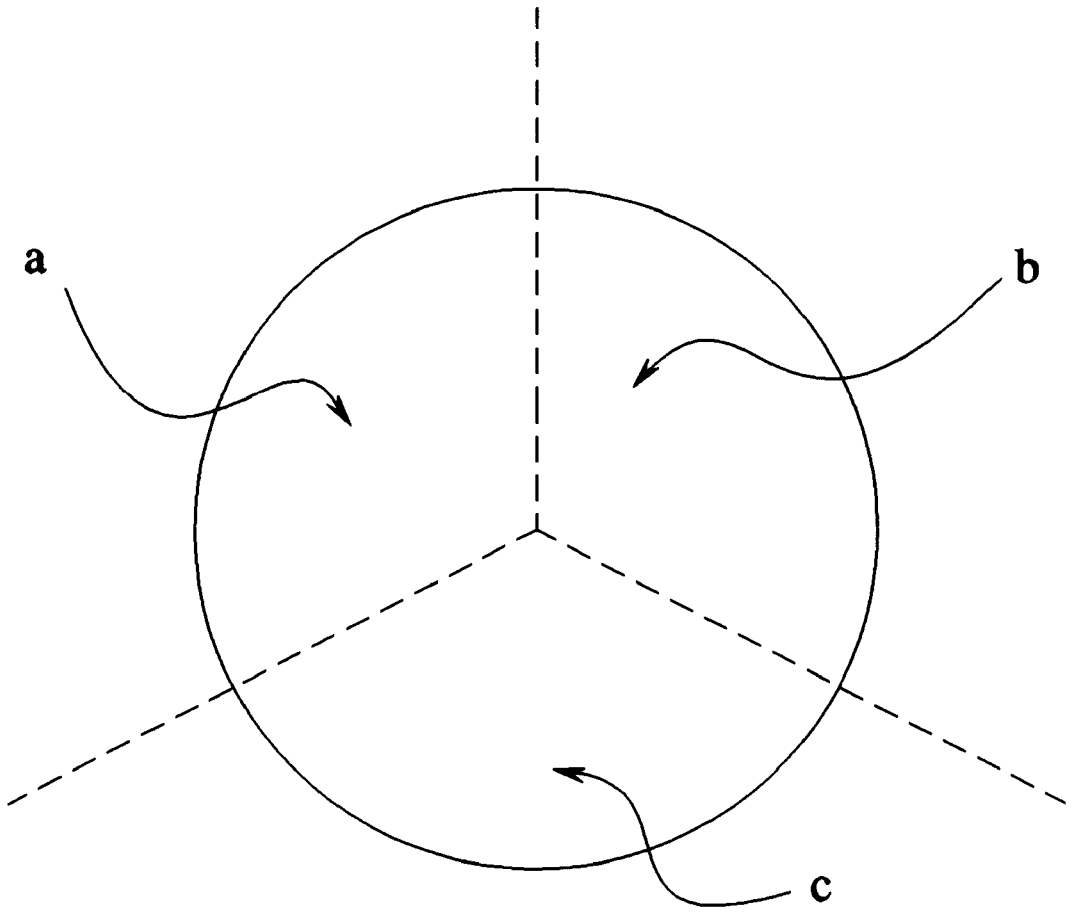
FIG. 3 is a cross-sectional view taken along any of lines B—B, C—C or D—D in FIG. 2 showing vertical sampling regions a, b, and c of water heater 12.
Figure 4:
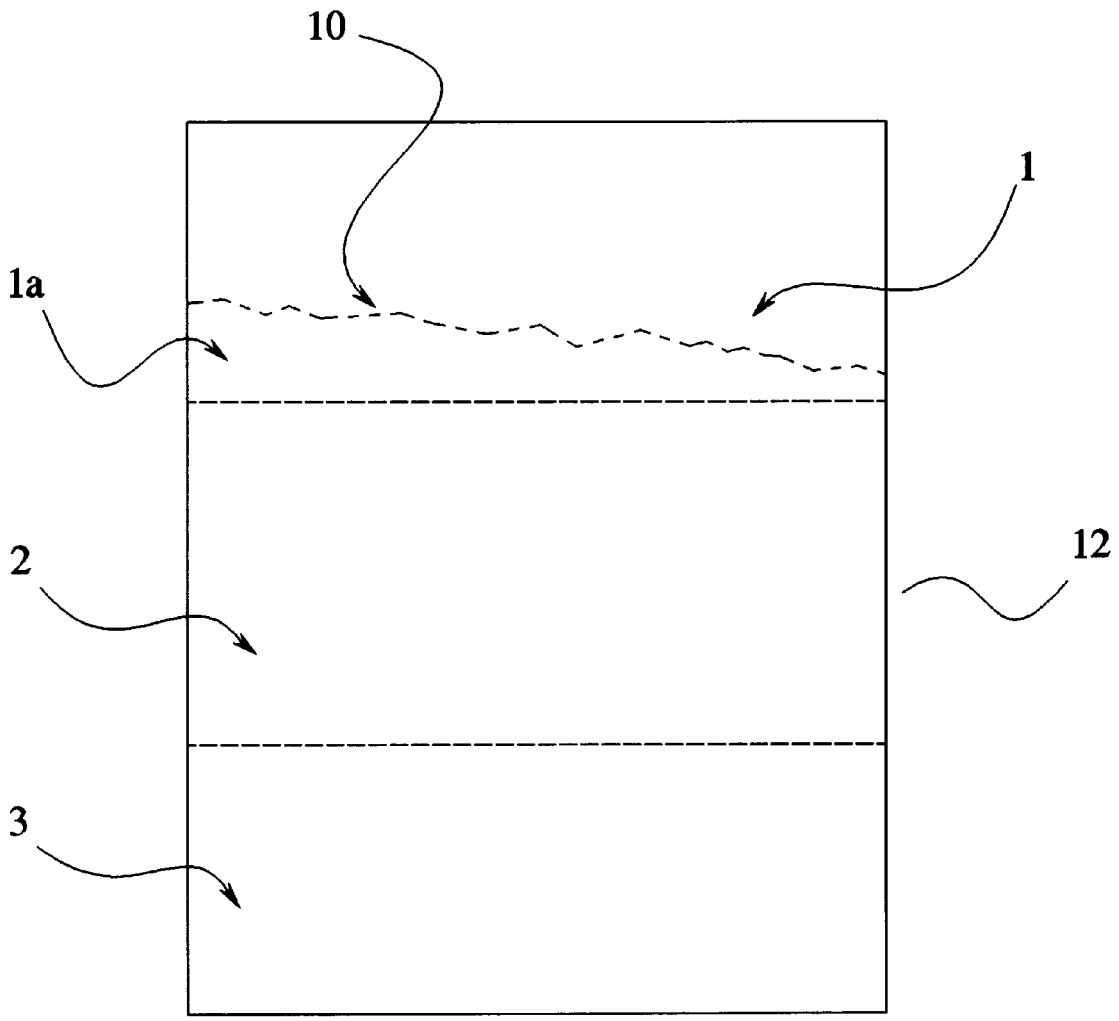
FIG. 4 is a vertical cross-sectional view of water heater 12 taken along line A—A in FIG. 2 showing foam sampling regions 1, 1*a*, 2, and 3. Line 10 represents the interface between water-blown foam found in regions 1*a*, 2 and 3 and HCFC 141*b*-blown foam in region 1.
Figure 5:
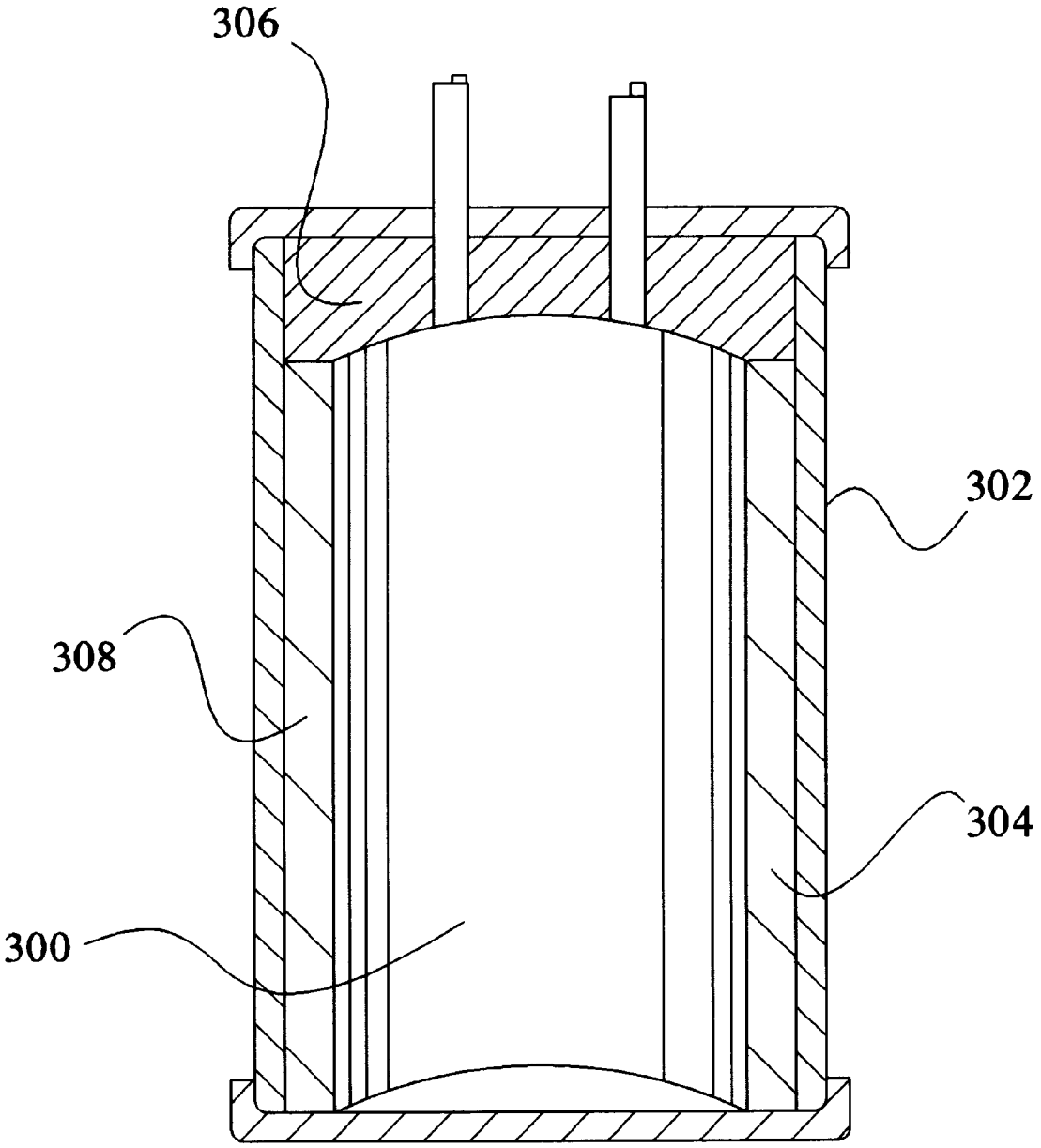
FIG. 5 is a diagrammatic illustration of a water heater according to the invention.
Figure 6:
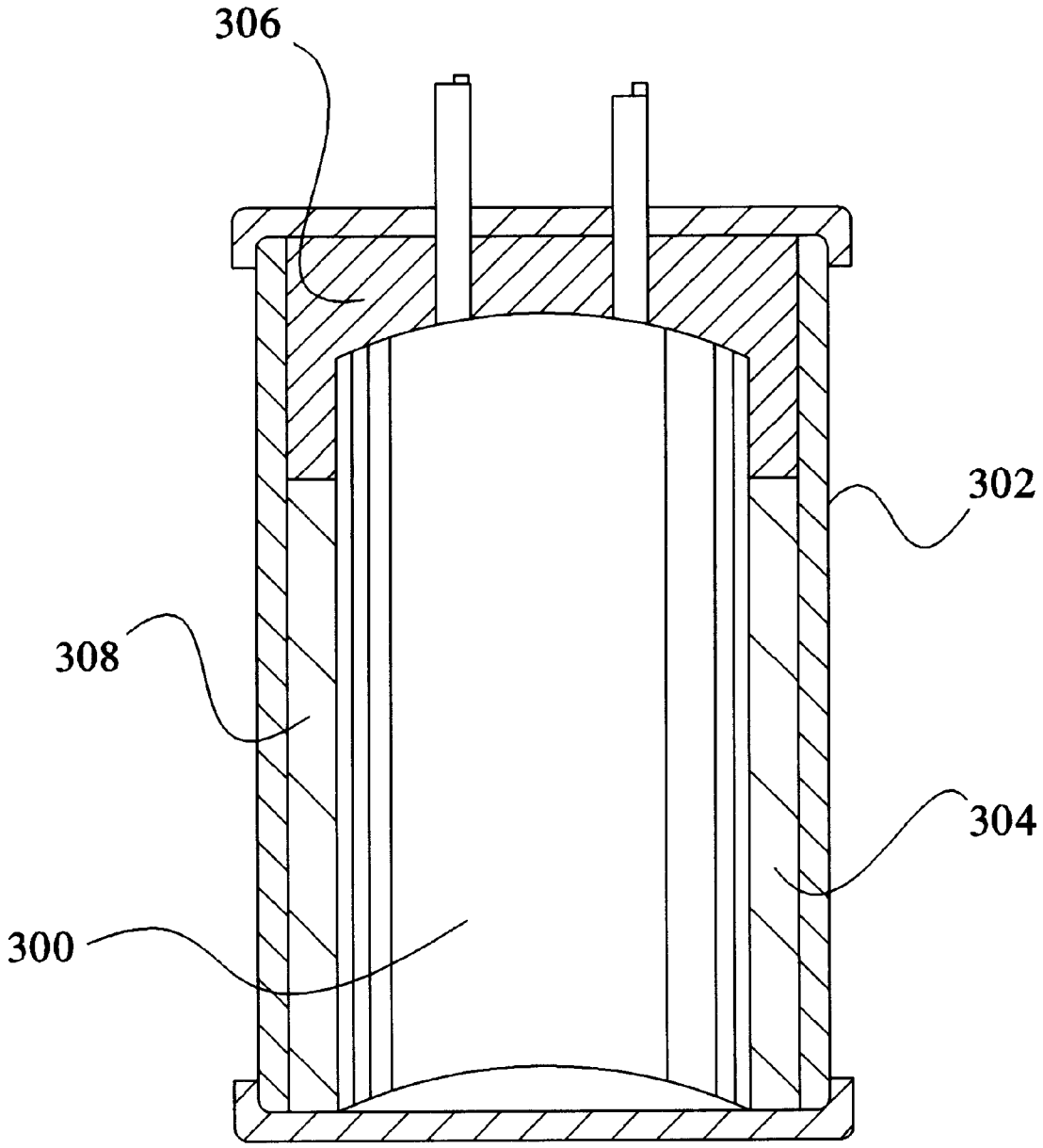
FIG. 6 is a diagrammatic illustration of a water heater according to the invention.

Foam density distribution in the water heater is determined by cutting approximately 2 in. ×2 in. ×0.7 in. foam pieces, in triplicate, from sections A–C in the water heater. See FIGS. 1–4. Exact weights and volumes of these foam pieces are used to determine foam density as shown below in Table 1.

Table 2 shows the overall mean foam density calculations and standard deviation of the data.

Table 3 shows a density analysis for three samples from the 141b-Blown foam region of the water heater.

TABLE 1

Water-Blown and 141b-Blown Foam Densities

| Sample | Length (in.) l | Width (in.) w | Height (in.) h | Weight (g) w | Dens. (pcf) d |
|---|---|---|---|---|---|
| Water-Blown | | | | | |
| A | 1.969 | 1.954 | 0.711 | 1.608 | 2.24 |
| | 1.928 | 1.962 | 0.698 | 1.939 | 2.80 |
| | 1.966 | 1.976 | 0.707 | 1.721 | 2.39 |
| B | 1.912 | 1.968 | 0.705 | 1.601 | 2.30 |
| | 1.960 | 1.968 | 0.698 | 1.675 | 2.37 |
| C | 1.933 | 1.950 | 0.703 | 1.552 | 2.23 |
| | 1.933 | 1.968 | 0.704 | 1.675 | 2.38 |
| | 1.967 | 1.958 | 0.709 | 1.703 | 2.38 |
| 141-B Blown | | | | | |
| A (9652) | 1.968 | 1.960 | 0.705 | 1.775 | 2.49 |
| B (9652) | 1.964 | 1.967 | 0.695 | 1.524 | 2.16 |
| C (9652) | 1.958 | 1.920 | 0.704 | 1.141 | 1.64 |

TABLE 2

Mean Water-Blown and 141b-Blown Foam Densities

| ANALYSIS SAMPLE | Density Mean | S.D. |
|---|---|---|
| A (9645) | 2.47 | 0.29 |
| B (9645) | 2.33 | 0.05 |
| C (9645) | 2.33 | 0.09 |
| 141b (9652) | 2.10 | 0.43 |
| Overall Mean Density | 2.380 | |
| AVG Std Deviation | 0.176569 | |
| Sum of Squares | 0.094 | |

TABLE 3

141b-Blown Foam Densities
ANALYSIS OF 141b-Blown (C)

| Length (in.) l | Width (in.) w | Height (in.) h | Weight (g) w | Dens. (pcf) d |
|---|---|---|---|---|
| 1.958 | 1.920 | 0.704 | 1.141 | 1.64 |
| 1.960 | 1.976 | 0.982 | 1.673 | 1.68 |
| 1.960 | 1.998 | 0.961 | 1.704 | 1.73 |
| | | | AVG | 1.68 |

The energy efficiency of the water heater prepared in Example 1, was compared to that of a traditional, all water blown foam water heater of similar manufacture. Energy efficiency tests were performed according to 11 CFR Ch. II (1-1-89 Edition); "Uniform Test Method for Measuring the Energy Consumption of Water Heaters", the results or which are shown below. The higher the energy rating number, the more energy efficient the water heater.

| Water Heater | Energy Rating Number |
|---|---|
| Example 1 (2 Component Foam System) | 0.892 |
| Conventional All Water-Blown System | 0.864 |

From the foregoing, it be appreciated that although specific embodiments of the invention have been described herein for purposes of illustration, various modifications may be made without deviating from the spirit or scope of the invention.

What is claimed is:

1. A water heater construction comprising:

(a) an inner water tank;

(b) outer enclosure means disposed over and around said inner water tank and defining therebetween a clearance space;

(c) a composite foam insulation system foamed in place between the tank and outer enclosure means in said clearance space;

(d) wherein the composite foam insulation system has at least two distinct foam components;

(e) wherein the composite foam insulation system comprises a first foam component and a second foam component;

(f) wherein the first foam component possesses lesser uniformity in cell structure as compared to the second foam component;

(g) wherein the first foam component is located in the volume disposed over the top of said inner water tank and the second foam component is located in the lower portion of the volume of said composite foam insulation system disposed around the side and/or bottom of said inner water tank;

(h) wherein any portion of said clearance space, including clearance space located around said inner water tank, below the first foam component, comprises the second foam component.

2. The water heater construction according to claim 1, wherein the second foam component is another type of insulation material, different from the first foam component.

3. The water heater construction according to claim 1, wherein the first foam component and the second foam component are added to the clearance space independently.

4. The water heater construction according to claim 1, wherein the first foam component is blown with a blowing agent; wherein the blowing agent is at least one volatile blowing agent selected from the group consisting of hydrochlorofluorocarbons of one or two carbon atoms, hydrofluorocarbons of two to four carbon atoms, perfluorocarbons of four to six carbon atoms, methylene chloride, a hydrocarbon of 1 to 8 carbon atoms, pentane, cyclopentane and chloropentane, or a mixture thereof, or a mixture of the volatile blowing agent with water.

5. The water heater construction according to claim 1, the second foam component is water-blown.

6. The water heater construction according to claim 1, wherein the second foam component is dimensionally stable in the free-rise state.

7. The water heater construction according to claim 1, wherein the second foam component is a substantially open celled foam.

8. A water heater construction comprising:

(a) an inner water tank;

(b) outer enclosure means disposed over and around said inner water tank and defining therebetween a clearance space;

(c) a composite foam insulation system foamed in place between the tank and outer enclosure means in said clearance space;

(d) wherein the composite foam insulation system has at least two distinct foam components;

(e) wherein the composite foam insulation system comprises a first foam component and a second foam component;

(f) wherein the first foam component possesses lesser uniformity in foam density as compared to the second foam component;

(g) wherein the first foam component is located in the volume disposed over the top of said inner water tank and the second foam component is located in the lower portion of the volume of said composite foam insulation system disposed around the side and/or bottom of said inner water tank;

(h) wherein any portion of said clearance space, including clearance space located around said water tank, below the first foam component, comprises the second foam component.

9. The water heater construction according to claim 8, wherein the second foam component is another type of insulation material, different from the first foam component.

10. The water heater construction according to claim 8, wherein the first foam component and the second foam component are added to the clearance space independently.

11. The water heater construction according to claim 8, wherein the first foam component is blown with a blow agent; wherein the blowing agent is at least one volatile blowing agent selected from the group consisting essentially of hydrochlorofluorocarbons of one or two carbon atoms, hydrofluorocarbons of two to four carbon atoms, perfluorocarbons of four to six carbon atoms, methylene chloride, a hydrocarbon of 1 to 8 carbons atoms, pentane, cyclopentane and chloropentane, or a mixture thereof, or a mixture of the volatile blowing agent with water.

12. The water heater construction according to claim 8, the second foam component is water-blown.

13. The water heater construction according to claim 8, wherein the second foam component is dimensionally stable in the free-rise state.

14. The water heater construction according to claim 8, wherein the second foam component is a substantially open celled foam.

15. A water heater construction comprising:

(a) an inner water tank;

(b) outer enclosure means disposed over and around said inner water tank and defining therebetween a clearance spare;

(c) a composite foam insulation system foamed in place between the tank and outer enclosure means in said clearance space;

(d) wherein the composite foam insulation system has at least two distinct foam components;

(e) wherein the composite foam insulation system comprises a first foam component and a second foam component;

(f) wherein the first foam component possesses lesser foam density as compared to the second foam component;

(g) wherein the first foam component is located in the volume disposed over the top of said inner water tank and the second foam component is located in the lower portion of the volume of said composite foam insulation system disposed around the side and/or bottom of said inner water tank;

(h) wherein any portion of said clearance space, including clearance space located around said inner water tank, below the first foam component, comprises the second foam component.

16. The water heater construction according to claim 15, wherein the second foam component is another type of insulation material, different from the first foam component.

17. The water heater construction according to claim 15, wherein the first foam component and the second foam component are added to the clearance space independently.

18. The water heater construction according to claim 15, wherein the first foam component is blown with a blowing agent; wherein the blowing agent is at least one volatile blowing agent selected from the group consisting essentially of hydrochloroflurocarbons of one or two carbon atoms, hydrofluorocarbons of two to four carbon atoms, perfluorocarbons of four to six carbon atoms, methylene chloride, a hydrocarbon of 1 to 8 carbon atoms, pentane, cyclopentane and chloropentane, or a mixture thereof, or a mixture of the volatile blowing agent with water.

19. The water heater construction according to claim 15, the second foam component is water-blown.

20. The water heater construction according to claim 15, wherein the second foam component is dimensionally stable in the free-rise state.

21. The water heater construction according to claim 15, wherein the second foam component is a substantially open celled foam.

22. The water heater construction according to any of the preceding claims, wherein the water heater does not have to be pre-heated prior to the addition of the composite foam insulation system to the clearance space.

* * * * *